United States Patent [19]

Kondo

[11] 4,314,493

[45] Feb. 9, 1982

[54] AUTOMATIC RHYTHM PATTERN ACCOMPANIMENT EQUIPMENT

[75] Inventor: Yoh-Ichi Kondo, Kokubunji, Japan

[73] Assignee: Kabushiki Kaisha Kawai Gakki Seisakusho, Shizuoka, Japan

[21] Appl. No.: 133,154

[22] Filed: Mar. 24, 1980

Related U.S. Application Data

[63] Continuation of Ser. No. 961,067, Nov. 15, 1978, abandoned.

[30] Foreign Application Priority Data

Nov. 26, 1977 [JP] Japan ..... 52/141757
Nov. 29, 1977 [JP] Japan ..... 52/142951
Nov. 29, 1977 [JP] Japan ..... 52/142952

[51] Int. Cl.[3] ..... G10F 1/00
[52] U.S. Cl. ..... 84/1.03; 84/DIG. 12
[58] Field of Search ..... 84/1.03, DIG. 12, 1.24

[56] References Cited

U.S. PATENT DOCUMENTS 4,154,132 5/1979 Mishima ..... 84/DIG. 12

*Primary Examiner*—J. V. Truhe

*Assistant Examiner*—Forester W. Isen

*Attorney, Agent, or Firm*—Sughrue, Mion, Zinn, MacPeak and Seas

[57] ABSTRACT

An automatic rhythm-pattern accompaniment equipment is disclosed that can automatically stop the full-in rhythm sound superposed on or replacing the accompaniment rhythm sound in synchronization with the beat number determination signal. According to a feature of this invention, the automatic rhythm accompaniment equipment comprises a fill-in circuit synchronized with basic rhythm pattern and fill-in beat number determination circuit, a fill-in rhythm-pattern designation circuit and a fill-in rhythm-pattern generator. Therefore, the stop of the fill-in rhythm is carried out automatically by the electronic circuit in synchronization with the beat number determination signal, although the insertion of it is manually done by the music player. If necessary, the insertion of the fill-in rhythm can be synchronized with the beat number determination signal. Moreover, according to this invention, desired one or more of the instrumental musical sounds involved in the accompaniment rhythm sound can be eliminated when the fill-in rhythm sound was generated, enhancing the fill-in effect.

11 Claims, 13 Drawing Figures

AUTOMATIC RHYTHM PATTERN ACCOMPANIMENT EQUIPMENT

This is a continuation of application Ser. No. 961,067, filed Nov. 15, 1978, now abandoned.

BACKGROUND OF THE INVENTION

This invention relates to an automatic rhythm-pattern accompaniment equipment for an electronic musical instrument, capable of inserting so called fill-in rhythm for a short period when a rhythm-pattern is shifted from one pattern to another while the instrument is being played.

A player often needs to change an accompaniment rhythm-pattern—a basic rhythm-pattern or a variation rhythm-pattern—directly into another accompaniment rhythm-pattern. In the automatic rhythm-pattern accompaniment equipment of conventional electronic musical instruments, it is often the case that an unusual acoustical change occurs when a rhythm is changed into another rhythm having no relevance to the previous one. For a continuous variation of playing rhythm-pattern, it has been practiced to insert a switch-over rhythm for a short period on playing drums which is called "fill-in".

An electronic musical instrument has been known that can automatically generate accompaniment rhythm-pattern and has capacity to insert a rhythm when operated manually. In the conventional electronic musical instrument of this kind, the player must close the switch at the moment the fill-in rhythm is inserted in order to superpose the fill-in sound on the rhythm sound being played, and he must open the switch at the exact moment the rhythm-pattern is changed. Therefore, it was difficult to adjust the time accurately. Since the output of the clock pulse oscillator for the accompaniment rhythm-pattern is asynchronous to the output of the pulse generator for the fill-in rhythm, the new fill-in rhythm pattern does not match well to said existing rhythm-pattern, so that is was difficult to eliminate unusual acoustic effect.

SUMMARY OF THE INVENTION

Accordingly, it is an object of the present invention to provide an automatic rhythm-pattern accompaniment equipment in which insertion and/or stop of a fill-in rhythm are easily done when the manual on-off circuit combined with an electronic circuit is operated, instead of manual direct insertion and stop of fill-in rhythm.

Another object of this invention is to provide an automatic rhythm-pattern accompaniment equipment that can offer a fill-in rhythm synchronized with the accompaniment rhythm-pattern.

A further object of this invention is to provide an automatic rhythm-pattern accompaniment equipment in which at least a part of the accompaniment rhythm-pattern can be erased when inserting a fill-in rhythm to be superposed.

DETAILED DESCRIPTION OF THE INVENTION

Figure 1:
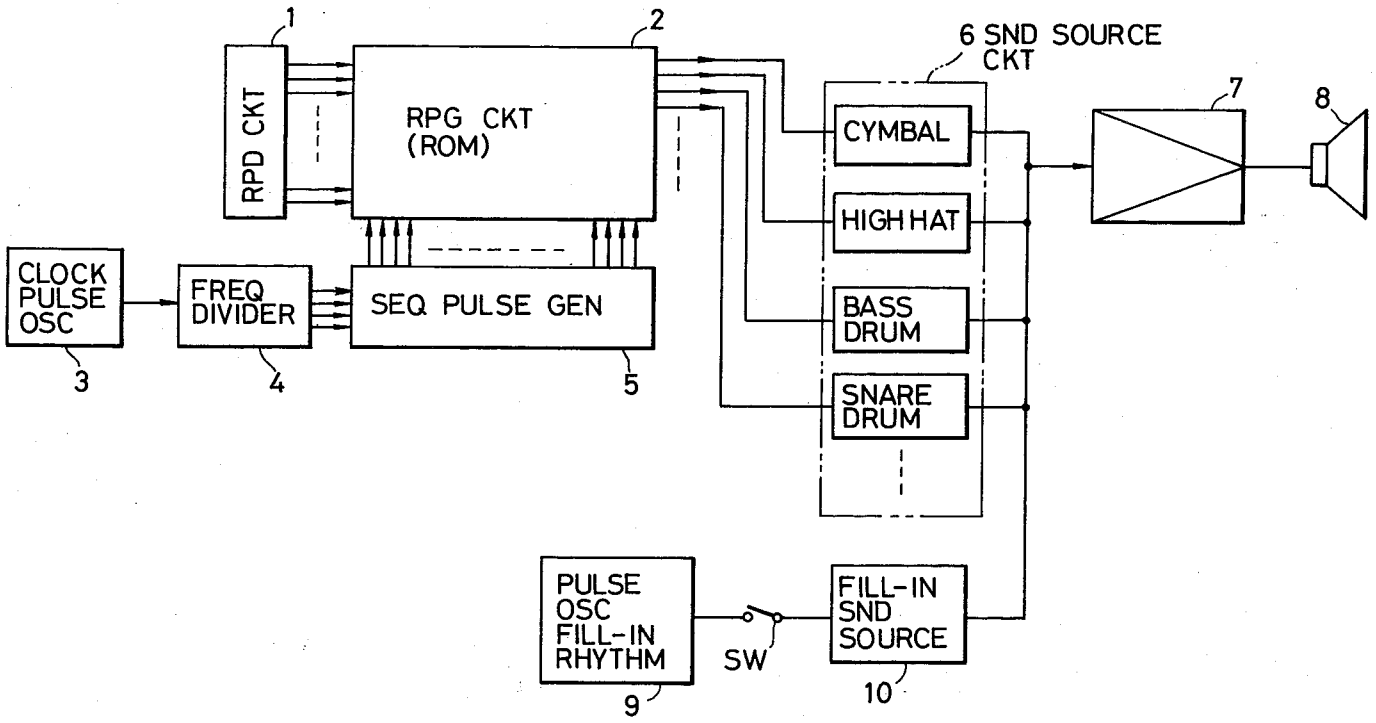
FIG. 1 is a block diagram illustrating a conventional automatic rhythm-pattern accompaniment equipment capable of generating fill-in rhythms.

FIG. 1 shows a configuration in which fill-in operation can be manually achieved in a prior art electronic musical instrument capable of automatic rhythm-pattern accompaniment. The rhythm-pattern designation (RPD) circuit 1 favorably includes preset selection switches to produce a pattern selection signal. The output from RPD circuit 1 is applied to an accompaniment rhythm-pattern generator (RPG) circuit 2. The output of the clock pulse oscillator 3 is fed to the pulse frequency divider 4. Usually, the divider 4 is a binary counter with its outputs at the various stages which are combined at a sequence pulse generator 5 in order to give sequence pulses. The RPG circuit 2, usually provided with a ROM (Read Only Memory), produces a desired rhythm-pattern when receiving both the input from RPD circuit 1 and the sequence pulses. Said rhythm-pattern is applied to the inputs of the desired sound sources (e.g., cymbal, bass drum, etc.) in the sound source circuit 6. An accompaniment rhythm sound signal generated therein is amplified at an amplifier 7 and then radiated from the loudspeaker 8 as a musical sound. The output of the fill-in rhythm pulse oscillator 9 is fed through a switch SW to a single fill-in sound source 10, e.g., generator of a snare-drum repeated sound. Therefore, if the player closes the switch SW in order to activate the fill-in sound source 10, for a short time at the moment the fill-in rhythm is to be inserted, the outputs of the fill-in sound source 10 together with the outputs of said sound source circuit 6 are applied to the amplifier 7.

In this rhythm accompaniment equipment, the switch SW must be opened at the moment the rhythm-pattern is changed. It is, however, very difficult to perform it completely. Since the oscillator 3 is not synchronized with the oscillator 9, the inserted fill-in rhythm bears no relation to the existing rhythm in tempo. When a shift is made from the existing rhythm-pattern to a new rhythm-pattern having different tempo, the fill-in rhythm often can not adapt itself to the new rhythm-pattern.

Figure 2:
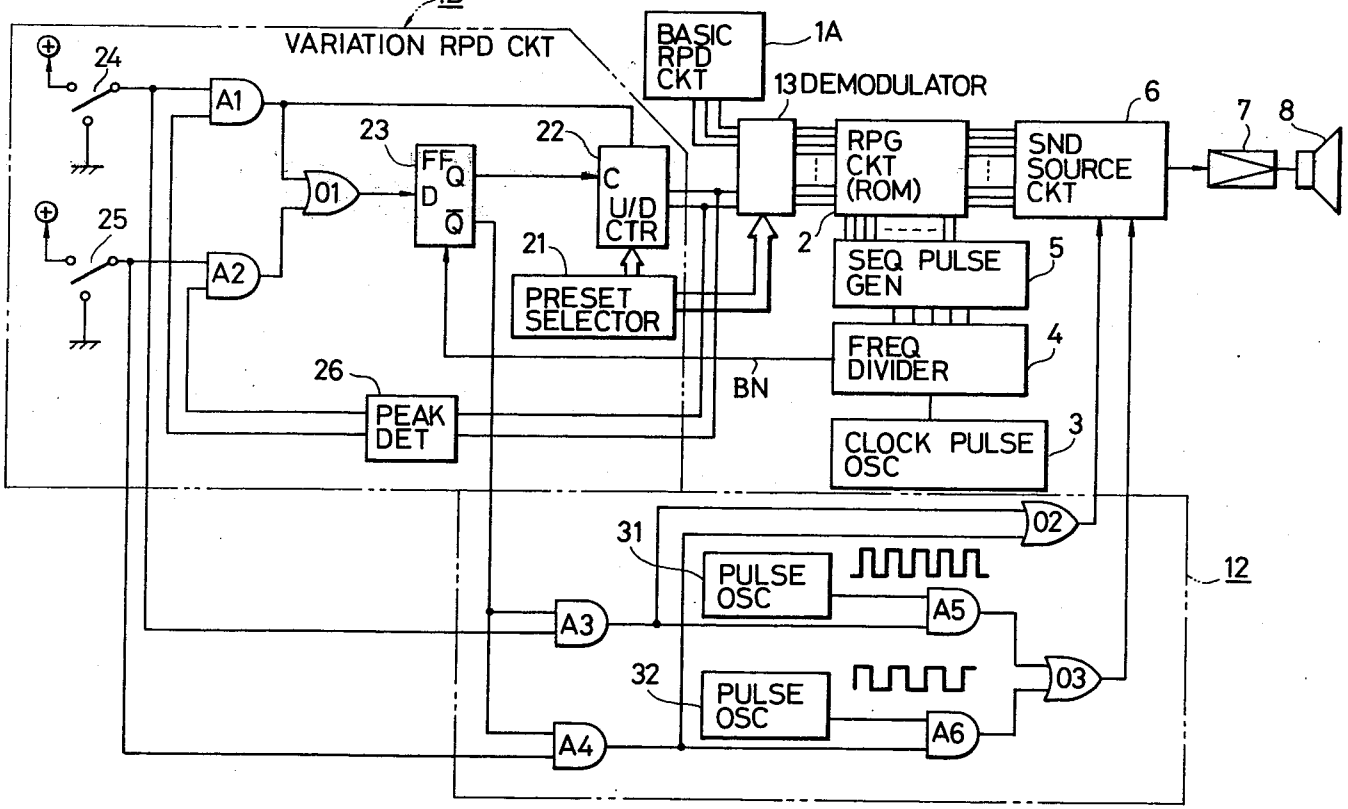
FIG. 2 is a block diagram of a first embodiment of this invention.
Figure 3:
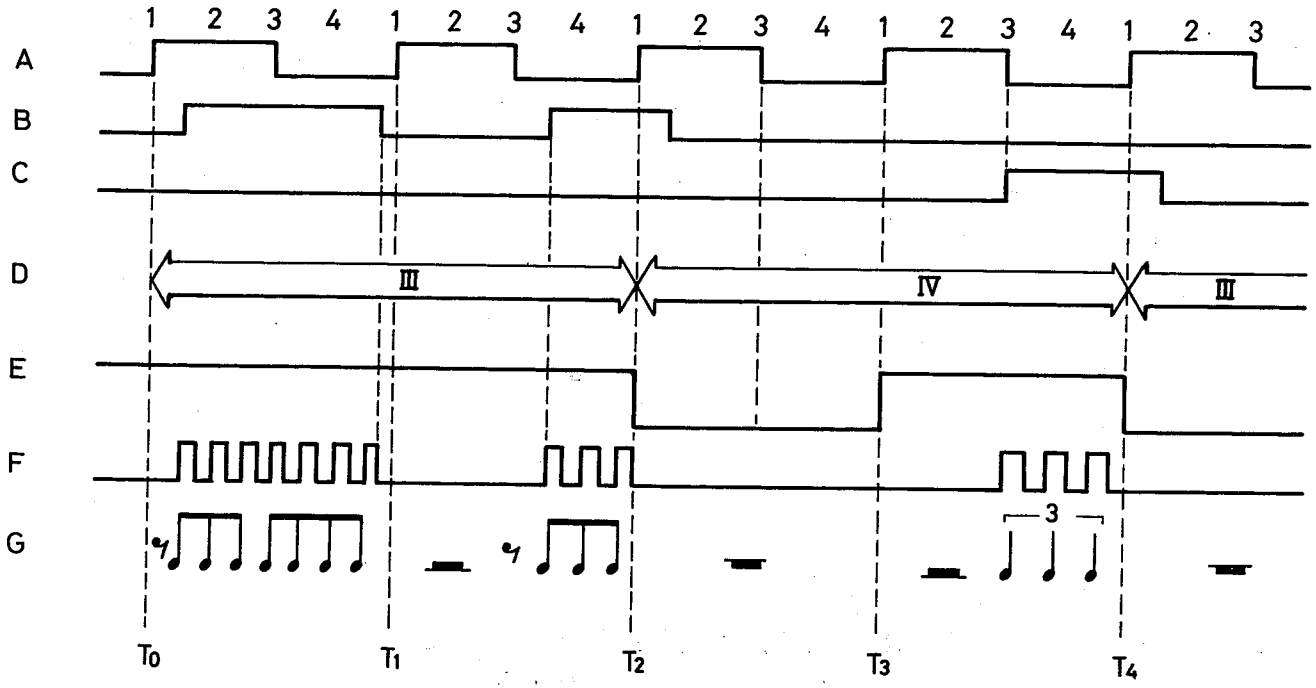
FIG. 3 is a time chart of the operation of the system shown in FIG. 2.

FIG. 2 is a block diagram of a first embodiment of this invention, and FIG. 3 is the time table of operation of the system of FIG. 2. The parts given by the same number as those of FIG. 1 are the same or equivalent parts. This system includes a basic rhythm-pattern designation circuit 1A, a variation rhythm-pattern designation circuit 1B, a signal source circuit 12 for obtaining rhythm other than basic and variation rhythm-pattern, for example so called fill-in rhythm, and a decoder 13.

The variation rhythm-pattern designation circuit 1B includes a preset selection switch 21, up-and-down (or reversible) counter 22, a delay type flip-flop 23, step-up and step-down switches 24 and 25 for changing the variation rhythm-pattern, a detector 26 for detecting the peaks of the step-up and step-down, and logical operation circuits A1, A2, and 01. The fill-in rhythm signal source circuit 12 consists of pulse oscillators 31 and 32 which provide the rhythms other than basic and variation rhythms, and logical operation circuits A3, A4, A5, A6, 02 and 03. The pulse oscillators are illustrated as independent ones, but in practice at least one of them may be replaced by one of outputs of the frequency divider 4. The oscillators can also be replaced by another frequency dividers supplied with the pulses from the clock pulse oscillator 3. Favorably, those pulses are snychronous to the beat of the rhythm-pattern generation.

The basic RPD circuit 1A produces a three bit signal, for example, in accordance with the operation of the preset selection switch not shown in the figure. This signal is fed to the upper three bits of the decoder 13.

In the variation RPD circuit 1B, an initial value set at the preset selection switch 21 is transferred to the U/D (Up-and-Down) counter 22. The output of the U/D counter 22 is fed to the lower two bits of the decoder 13, where an address designation signal for RPG circuit 2 is produced based on said five bits. If the address of the pattern designated by the output of the decoder 13 is the variation pattern III, the output of the sequence pulse generator circuit 5 and the RPG circuit 2 give the variation pattern III to the sound source circuit 6. The sound source circuit 6 operates in the known manner and generates the variation pattern III so that the loudspeaker 8 radiates the pattern III.

A change from variation pattern III to pattern IV is carried out when a positive voltage is applied to AND gates A1 and A3 by turning on the step-up switch 24. Since the flip-flop 23 is of delay type, it does not immediately respond to the signal fed through AND gate A1 and OR gate 01. The state of the flip-flop is reversed at the arrival of beat number signal BN from the frequency divider 4. In other words, the output Q of the flip-flop 23 comes to 'H' (or its high level) at the leading edge of the BN signal under the condition that the 'H' (a positive voltage) is applied to the input D through OR gate 01.

The operation will be explained below referring to the time table of FIG. 3. When the beat number signal BN varies as shown in A of FIG. 3, the step-up switch 24 closes (B in FIG. 3), and provides 'H' to the input D of the flip-flop 23. The output $\overline{Q}$ of the flip-flop 23, however, remains unchanged during the time between T0 and T1, keeping the state 'H'. The AND gate A3, supplied with 'H' through switch 24 and $\overline{Q}$ (E in FIG. 3) of the flip-flop 23, gives 'H', which goes to the AND gate A5 and opens it. Therefore, the pulses fed to the other input of the gate A5 can pass through the gate. These pulses are supplied through OR gate 03 to the sound source circuit 6 (F in FIG. 3), where they form a desired fill-in rhythm (G in FIG. 3) which is superposed on the variation rhythm-pattern III (D in FIG. 3). The superposed pattern is taken out through the loudspeaker 8. The output of the AND gate A3 can further be applied through OR gate 02 to the sound source 6, preventing generation of the rhythm by the same sort of instrument as the instrument producing the rhythm sound according to the output of the OR gate 03. In such case as the fill-in rhythm is the repeated sound of snare-drum, the output of the OR gate 02 suppresses the sound of the snare drum involved in the pattern generated by RPG circuit 2. It provides such additional effect as to make one pay much attention to the fill-in rhythm. The generation of the original variation rhythm-pattern can be inhibited also by the signal fed from the OR gate 02 to the sound source 6. Then, only fill-in rhythm is radiated from the loudspeaker so that the effect of fill-in is outstanding.

In the example of FIG. 3, the variation rhythm-pattern III remains unchanged even after the time T1, as the switch 24 becomes off before the rise time T1 of the beat number signal pulse BN and hence the beat number signal pulse can not coincide with the output of the OR gate 01. However, if the step-up switch is operated once more before the time T2 at which the beat number signal pulse rises, the fill-in rhythm is produced again (G in FIG. 3). At the time T2, the switch-over of the flip-flop 23 changes the variation rhythm-pattern from III to IV and stops the fill-in rhythm. If the step-down switch 25 is operated between T3 and T4 (C of FIG. 3), the fill-in rhythm takes place—it is better to use a fill-in rhythm different from said one for agreeable sound—and at the end of the rhythm the variation rhythm-pattern is again shifted from IV to III.

In the first embodiment, it is in the variation rhythm that a shift is made, but it is obvious that the basic rhythm may also be varied.

Figure 4:
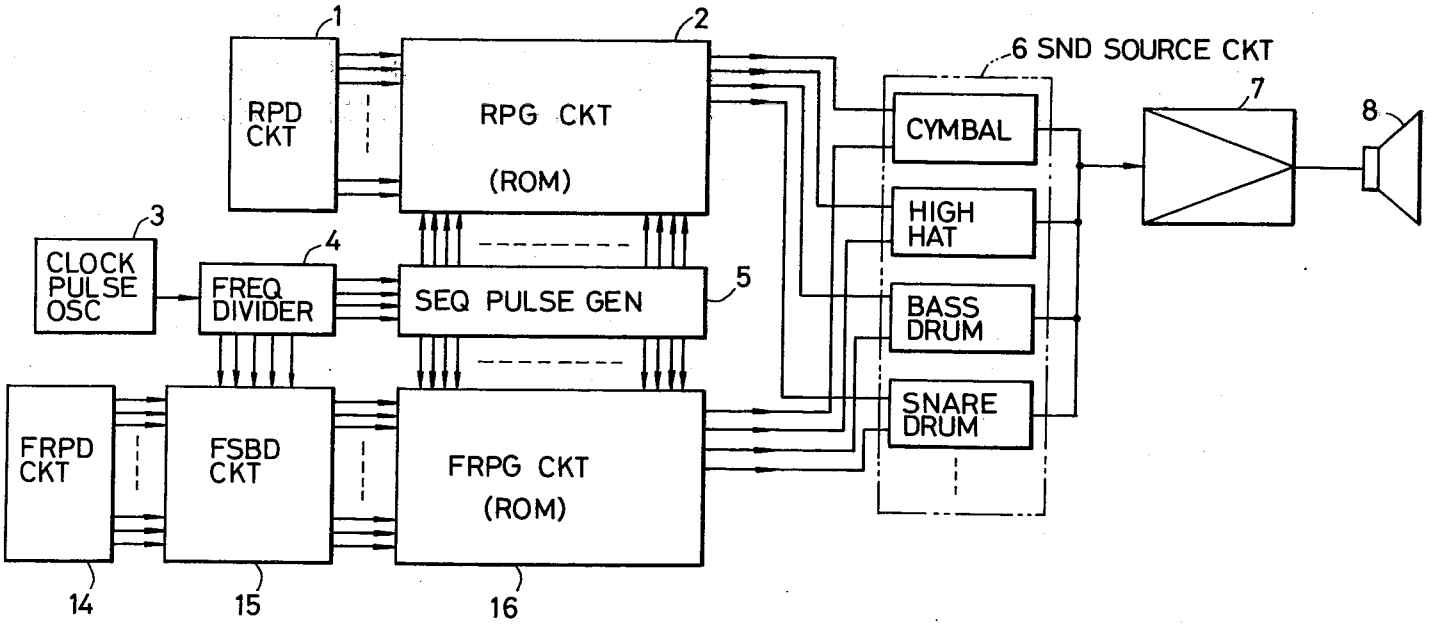
FIG. 4 is a schematic block diagram of a second embodiment of this invention.

FIG. 4 is a block diagram of a second embodiment of this invention, where the same number as that of FIG. 1 denotes the same or equivalent function block. The block 14 is a FRPD (fill-in rhythm-pattern designation) circuit conveniently including a self-recovery switch. Block 15 is a FSBD (fill-in beat number decision circuit synchronized with basic rhythm pattern and fill-in beat number decision) circuit to which the output of the pulse frequency divider 4 and that of FRPD circuit 14 are applied. The block 16 is a FRPG (fill-in rhythm-pattern generator) circuit which may be a read-only memory ROM for memorizing various patterns just like RPG circuit 2. The output of the FRPG circuit 16 and those of ROM 2 are applied to the sound source circuit 6. Since pulses synchronized with the clock pulses for accompaniment rhythm-pattern are supplied from the frequency divider 4 to FSBD circuit 15, a pattern designated in FRPD circuit 14 is superposed on the accompaniment rhythm. Thus, a fill-in rhythm synchronized with the accompanimet rhythm is radiated from the loudspeaker 8. The fill-in rhythm can be easily changed by changing the combination of set switches in the FRPD circuit 14, and the tempo of the fill-in rhythm is determined by a common clock pulse oscillator 3. Therefore the present system is free from such conventional disadvantage that the fill-in rhythm-pattern is asynchronous to the accompaniment rhythm-pattern.

Figure 5:
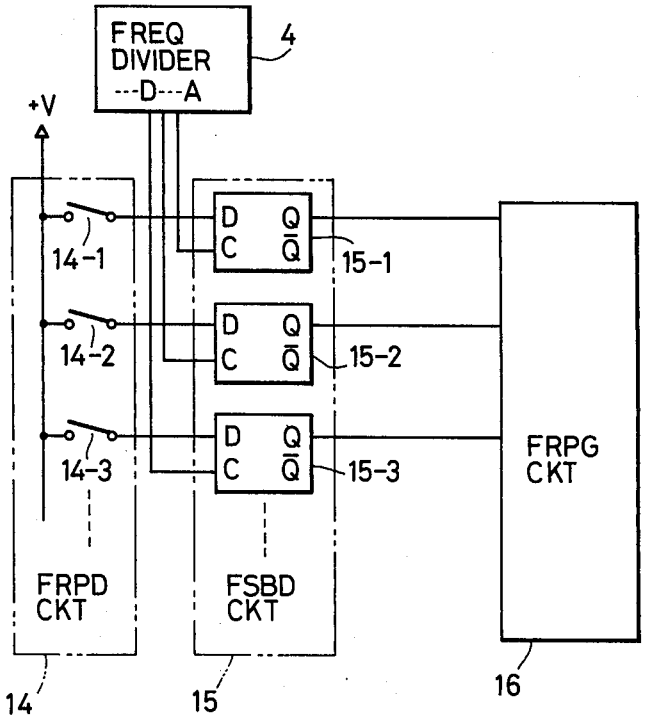
FIG. 5 is a block diagram illustrating in detail the fill-in circuit snychronized with the basic rhythm-pattern and a fill-in beat number decision circuit of FIG. 4.
Figure 7:
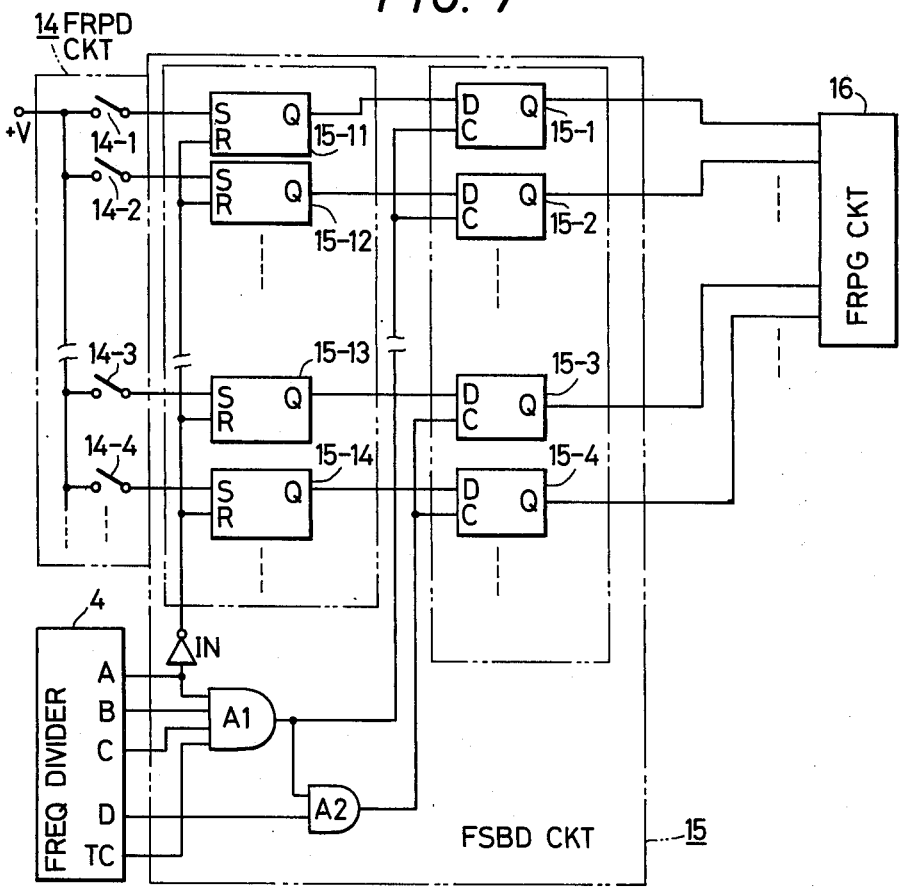
FIG. 7 shows another example of fill-in circuit synchronized with the basic rhythm-pattern and a fill-in beat number determination circuit of FIG. 4.

The FSBD circuit 15 of FIG. 4 is shown in detail in FIGS. 5 and 7.

Figure 6:
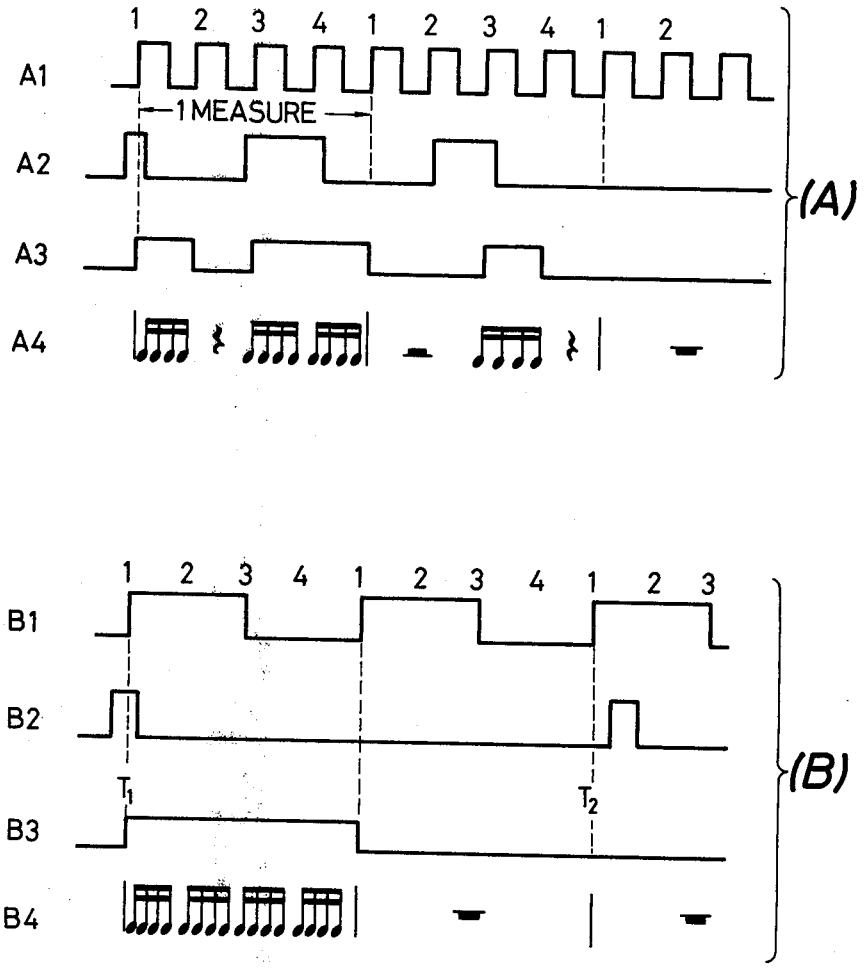
FIGS. 6*a* and 6*b* are time charts of the circuits shown in FIG. 5.

FIG. 5 illustrates an example of FSBD circuit 15 in which delay type flip-flops are employed as condition selecting circuits and their outputs are used to determine the pattern produced at the FRPG circuit 16, and FIG. 6 shows the time table of its operation. Each of the delay type flip-flops 15-1, 15-2 . . . has an input connected with an output of respective selection on-off circuits 14-1, 14-2 . . . in the FRPD circuit 14. The other input of each flip-flop is connected with one of the output terminals A . . . D . . . of the pulse frequency divider 4. Because of the dynamic characteristics of the delay type flip-flop, the fill-in rhythm is generated when the output Q is turned to 'H' for example. The on-off operation of switches 14-1 and 14-3 are shown by wave forms A2 and B2 in FIG. 6. The wave forms A1 and B1 are an example of outputs at the terminals A and D of the frequency divider 4 and act as beat number signals (clock pulses). As shown by the wave forms A3 (or B3), the 'H' at the output of each flip-flop starts at the moment the pulse wave form A1 (or B1) from the output terminal A (or D) of the pulse frequency divider 4 rises under the condition that the signal 'H' is kept supplied from the selection switch 14-1 (or 14-3), and ends at the leading edge of the pulse that arrives just after disapearance of the signal 'H'. An example of outputs of FRPG circuit 16 is given in FIG. 6, in forms of the musical notes A4 and B4. The number written above the clock pulses A1 (or B1) are the beat numbers. In the figure, the rhythm is quadruple time.

In A of FIG. 6, one beat corresponds to one pulse period and hence the minimum unit of the fill-in beat is one beat, but in B the minimum unit is one measure because there is only one pulse in one measure. In A of FIG. 6, the fill-in rhythm is produced every time the selection switch 14-1 is closed, but in B, it is not produced if the switch 14-3 is closed after T2 when the wave form B1 rises. That means, in this embodiment, the selection switches must be operated in advance to the rise time of the clock pulse. It is, however, very difficult for the player to operate the switch at a suitable time during his musical play.

Figure 8:
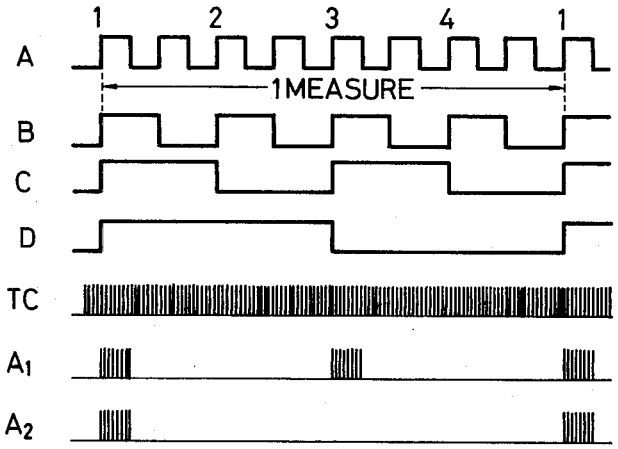
FIGS. 8, 9*a*, and 9*b* are time charts for the operation of the circuits shown in FIG. 7.
Figure 9:
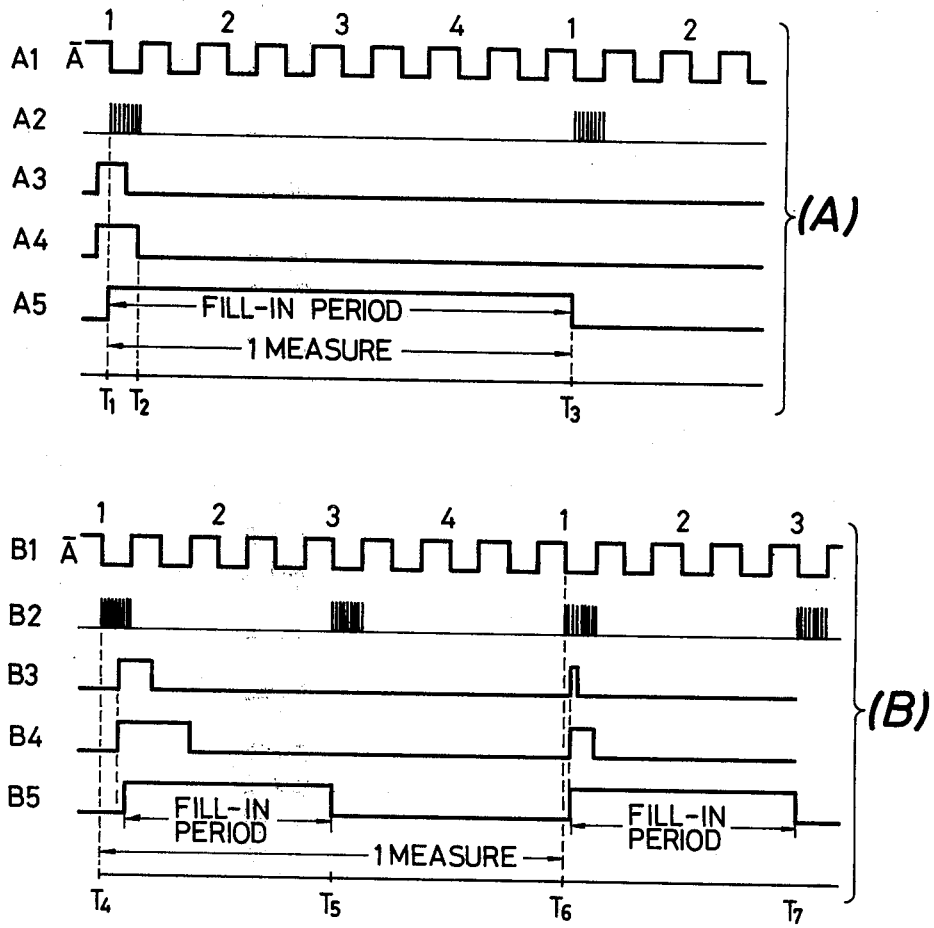

FIG. 7 shows an embodiment that facilitates the manipulation of said selection on-off circuit that requires precise timing. FIG. 8 shows the time table of the clock pulse. FIG. 9 shows the time table of the fill-in operation.

In FIG. 7, the same number as that of FIG. 5 indicates the same or equivalent function block. The block including 15-1, 15-2 . . . is a first condition selecting circuit having the same function as that of FIG. 5. The block consisting of 15-11, 15-12 . . . is a second condition selecting circuit utilizing set-reset flip-flop circuits in which priority is given to the set operation. The clock pulse output of the pulse frequency divider 4 includes high frequency clock TC as well as outputs A through D. The pulse repetition cycle of TC should be more than 10 times as high as the maximum frequency of the clock pulse (wave form A in FIG. 8) for the second condition selecting circuit. The outputs of the AND gates A1 and A2 are used as clock pulses for the first condition selecting circuit consisting of 15-1, 15-2 . . . In FIG. 8, four clock-pulse trains are illustrated in the order of A to D and the frequency of each train is a half of that of the above.

In FIG. 9 (A) shows an example in which the output of the AND gate A2 is used as the beat number determination signal for the first condition selecting circuit, and (B) shows another example in which the output of the AND gate A1 is used for the same purpose. A1 illustrates the wave form of the reset pulse $\overline{A}$ which appears at the output of inverter IN supplied with the clock pulse A from the frequency divider 4. If a voltage 'H' is given to the set terminal S of the second condition selecting circuit 15-13 by operating the on-off circuit 14-3 of the FRPD circuit 14 just before the time T1 as shown in wave form A3, the wave form A4 of the output Q becomes 'H' ("set" level) irrespective of the reset pulse $\overline{A}$ at the level 'H', because of the flip-flop type that gives priority to "set". This wave form A4 is applied to the first condition selecting circuit 15-3 so that its output Q (waveform AS) will go to 'H' as the clock pulse rises up (wave form A2). At the time T1, the reset pulse $\overline{A}$ becomes "L", but the output Q of the second condition selecting circuit remains at 'H'. The output Q becomes 'L' at the time T2 when the reset pulse $\overline{A}$ becomes 'H'. After T2, the clock pulse (wave form A2) for the first condition selecting circuit 15-3 is absent and hence the output (wave form A5) is kept at 'H' until the next clock pulse (wave form A2) occurs at the time T3. This is the period for the insertion of fill-in rhythm-pattern generator 16 begins to operate and provide a desired pattern of fill-in rhythm.

Next, operation will be explained about the case in which the closure of the selection switch 14-1 of FRPD circuit 14 is later than T4 as shown in B3 of FIG. 9. Since the on-off circuit 14-1 is closed after the initiation of the first beat of the reset pulse $\overline{A}$ (wave form B1), the second condition selecting circuit 15-11 is given a set pulse 'H' by the closure of the switch 14-1 together with the level 'L' of the reset pulse $\overline{A}$. Therefore, the flip-flop 15-11 is set and the output Q rises to 'H' (wave form B4). The output Q of the first condition selecting circuit 15-1 rises to 'H' when the clock pulse from the AND gate A1 (wave form B2) rises again as described hereinbefore (wave form B5). Also in this case, the 'H' of the first condition selecting circuit 15-1 last until the clock pulse (wave form B2) rises at the time T5, so that the fill-in rhythm is produced during this period. Because of this configuration, a little delay from the beginning of the beat is allowed for the player to manipulate the selection on-off circuit of the FRPD circuit 14. The maximum allowable delay time is equal to the length of the level 'L' of the reset pulse $\overline{A}$. In other words, if the length of said level 'L' is chosen at semiquaver, a delay of the semiquaver is allowed from the beginning of the beat. A momentary operation, exemplified at the time T6, is sufficient to get a fill-in rhythm, therefore the player is easy to operate.

Figure 10:
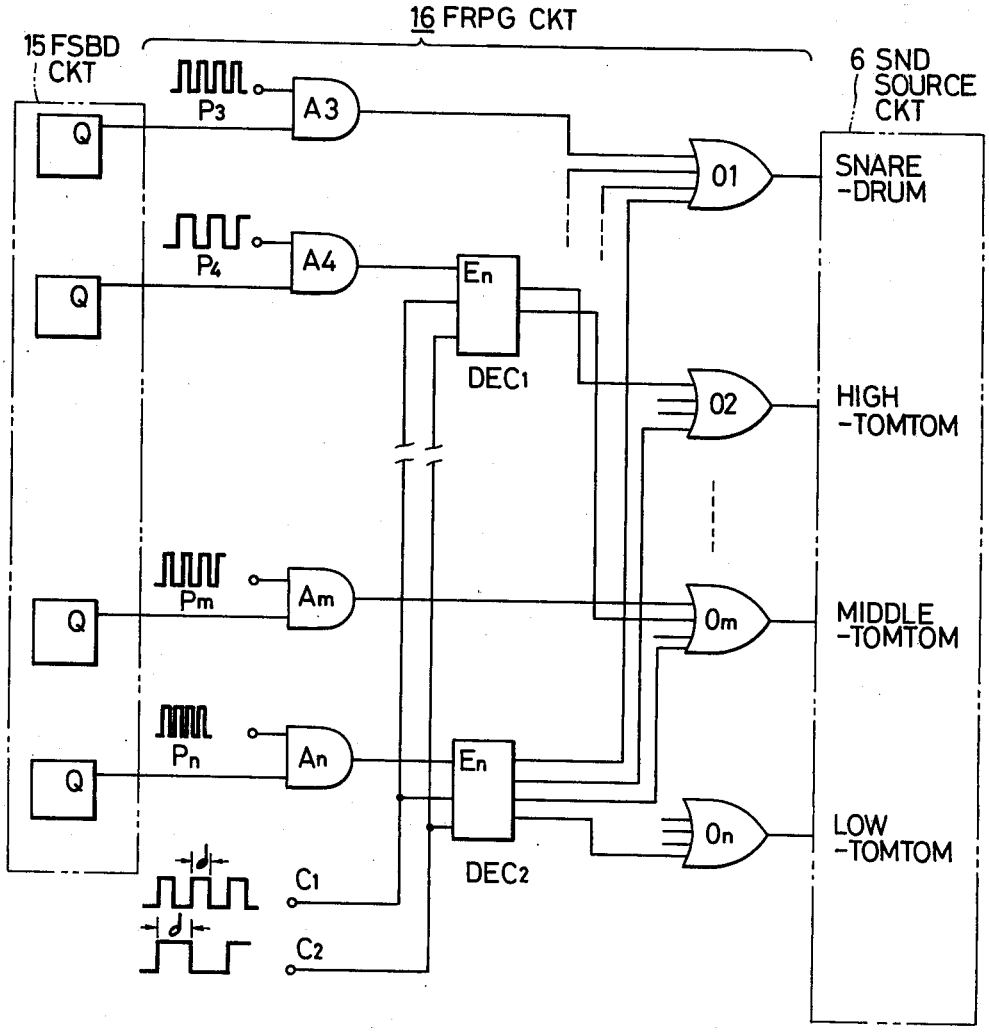
FIG. 10 shows an fill-in rhythm-pattern generator of FIG. 4.

FIG. 10 shows a FRPG circuit 16 composed of separate components instead of a ROM. In this figure, the parts indicated by the symbols A3–An are AND gates, 01–On are OR gates and DEC1 and DEC2 are decoders with enabling terminals En. A signal applied to an input of each AND gate is a short period pulse corresponding to the musical note of the fill-in rhythm, favorably derived from a common frequency divider 4 from the viewpoint of rhythm snychronization. When the FSDB circuit 15 gives a fill-in pulse to any one of the AND gates A3–An as shown by A5 or B5 in FIG. 9, an agreement of this pulse with the corresponding one of the pulses P3, P4 . . . , Pm, Pn each representative of the fill-in rhythm note is obtained and the result is fed through an OR gate to the sound source circuit 6. Thus, a desired fill-in rhythm-pattern, for example snare-drum repeated sound is generated. If the output of the AND gate is led to the decoder DEC1, a pattern comprising high-tomtom and middle-tomtom that appear alternatively every other beat is obtained with the aid of clock pulses C1 and C2. If the output of the AND gate is led to the decoder DEC2, a pattern is generated to permit snare-drum, high-tomtom, middle-tomtom and low-tomtom to appear by turn in every beat. The output from the AND gate is fed to the enabling terminal En for selective generation of the decoder output. If another form of clock pulse is applied to the decoder, the fill-in note can be allotted to each musical instrument in every two or half beats.

Figure 11:
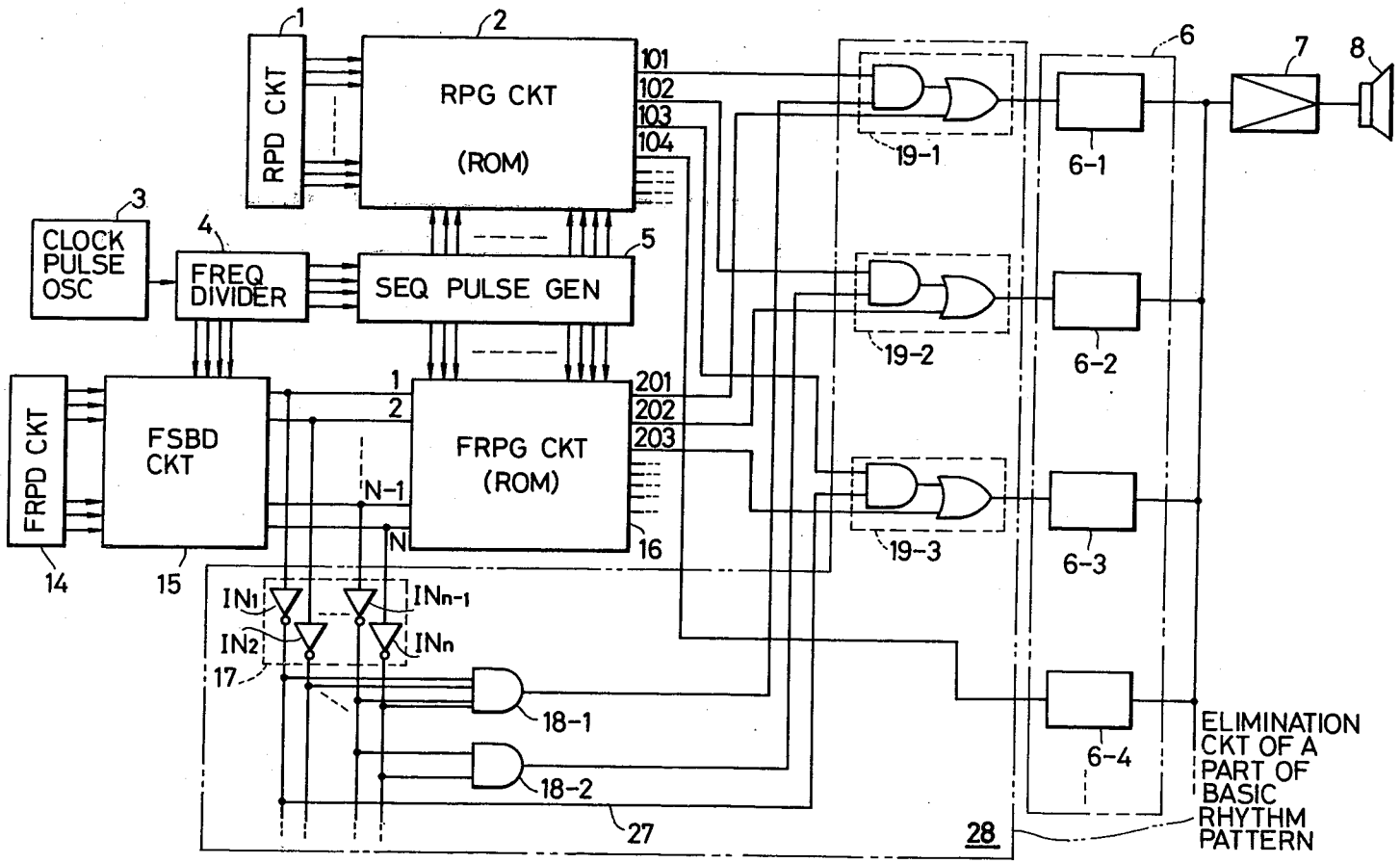
FIG. 11 is a block diagram of a third embodiment of this invention.

FIG. 11 illustrates the third embodiment of this invention and the same number as that of FIG. 4 indicates the same or equivalent part. The part enclosed by a dot-and-dash line is the circuit 28 employed in this embodiment for erasing a part of the basic rhythm-pattern. In the figure, a symbol 17 shows an inverter group composed of the same number of inverters LN1, IN2, . . . INn as that of the input terminals of FRPG circuit 16. The inputs of the FRPG circuit 16 are numbered from 1 to N, and the inverters connected to those inputs are denoted by IN1 . . . INn. 19-1, 19-2 . . . are basic rhythm-pattern selecting circuits each consisting of an AND gate and an OR gate, with the output connected to sound source of the sound source circuits 6, 18-1, 18-2 . . . are AND circuits. AND gate 18-1 is supplied inputs by all of IN1–INn, AND gate 18-2 by IN n-1 and INn, and other AND gates supplied with properly selected outputs of IN1–INn. The outputs of those AND gates are connected to the accompaniment rhythm-pattern selection circuits 19-1, 19-2 . . .

Suppose that FRPD circuit 14 is operated to chose No. 1 input terminal of FRPG circuit 16. The 'L' output of the inverter IN1 makes the AND gate 18-1 give 'L' output, which is applied to the basic rhythm-pattern selecting circuit 19-1. On the other hand, the output of the AND gate 18-2 remains 'H', which is fed to the selection circuit 19-2. The signal on the connection wire 27 becomes 'L' and applied to the selection circuit 19-3. Therefore, the output of the selection circuit 19-1 is the output at terminal 201 of FRPG circuit 16. The output of the selection circuit 19-2 is the superposition of the signal at the output terminal 102 of RPG circuit 2 and that at the output terminal 202 of FRPG circuit 16. The output of the selection circuit 19-3 is the output at terminal 203 of FRPG circuit 16. As mentioned above, in this embodiment some of the basic rhythm-patterns designated by RPD circuit 1 are erased. Under the prescribed assumption, the basic rhythm-patterns at the terminals 102 and 104 are allowed to pass, but those at the terminals 101 and 103 are erased. The output of the FRPG circuit 16 designated by the FRPG circuit 14 together with the outputs of RPG circuits 2 that are not erased, are fed to respective sound sources 6-1, 6-2, . . . 6-n in the sound source circuit 6, where rhythm sound signal of each pattern is generated.

Next, assume that the input terminal N-1 of FRPG circuit 16 is chosen, then the outputs of both AND gates 18-1 and 18-2 become 'L', and the signals from 101 and 102 of RPG circuit 2 are eliminated by the selection circuits 19-1 and 19-2. It will be obvious from description so far that the output from the terminal 101 of RPG circuit 2 is always eliminated whatever input terminal of FRPG circuit 16 is chosen. Therefore, the kind of the sound source 6-1 must be selected according to the fill-in rhythm applied. For the sound source 6-3 supplied by the elimination circuit 28 which is operated only when the first input of FRPG CIRCUIT 16 is marked, and for the sound source 6-4 that is free from the fill-in operation, care must be exercised when determining the kind of them.

The invertor group 17 can be omitted if delay type flip-flops are employed in the FGBD circuit 15. The reason is that each flip-flop has the output $\overline{Q}$ as well as Q and the former can be connected directly to one or more AND gate 18-1, 18-2 . . . or connection wire 27.

Thus, according to this invention the fill-in rhythm inserted to the accompaniment can be stopped in synchronization with the beat number determination signal BN. As it is easy to automatically insert the fill-in rhythm just before the change of rhythm-pattern, no unusual change is recognized.

Confirmation of a change in accompaniment rhythm-pattern may be done by hearing the inserted fill-in rhythm. Furthermore, the fill-in rhythm is easily synchronized in tempo with accompaniment rhythm-pattern. It is easy to remove the sound corresponding to one or more desired kinds of instrument from the accompaniment rhythm sound in order to emphasize the fill-in rhythm when it is inserted into the accompaniment rhythm.

What we claim is:

1. An automatic rhythm-pattern accompaniment equipment comprising:

an accompaniment rhythm-pattern generator for storing a plurality of accompaniment rhythm-patterns, an accompaniment rhythm-pattern designation circuit for selecting a desired one of said accompaniment rhythm-patterns to be read out, a sequence pulse generator providing an output to the accompaniment rhythm-pattern generator for the determination of signal read-out time of the accompaniment rhythm-pattern generator, a sound source circuit supplied with the read-out signal from the accompaniment rhythm-pattern generator for producing a selected accompaniment rhythm sound, said sound source circuit producing a first accompaniment rhythm sound when a first accompaniment rhythm-pattern is selected by said accompaniment rhythm pattern designation circuit and producing a second accompaniment rhythm sound when a second accompaniment rhythmpattern is selected by said accompaniment rhythm pattern designation circuit, said sound source switching from said first to said second accompaniment rhythm sound a predetermined time after said accompaniment rhythm-pattern designation circuit is switched from said first to said second accompaniment rhythm-patterns, a means for generating a beat number determination signal synchronized to the accompaniment rhythm sound, a means for generating a fill-in rhythm signal, a means for superimposing a fill-in rhyth onto the accompaniment rhythm sound in response to a designation of a switch-over of accompaniment rhythm-pattern, said means for superimposing operating to superimpose said fill-in rhythm during said predetermined time, and a means for stopping the superimposed fill-in rhythm in synchronization with the beat number determination signal, said means for stopping operating to stop the fill-in rhythm after said sound source has switched from said first to said second accompaniment rhythm sound.

2. An automatic rhythm-pattern acompaniment equipment as defined in claim 1, wherein said selected accompaniment rhythm sound includes sounds from a plurality of musical instruments and wherein said fill-in rhythm signal represents sounds from at least one of said plurality of musical instruments, said equipment further comprising means for suppressing the portion of the accompaniment rhythm sound corresponding to said at least one musical instrument in said fill-in rhythm-pattern.

3. An automatic rhythm-pattern accompaniment equipment comprising:

an accompaniment rhythm-pattern generator for storing a plurality of accompaniment rhythm-patterns, an accompaniment rhythm-pattern designation circuit for selecting a desired one of said accompaniment rhythm-patterns to be read out, said accompaniment rhythm-pattern designation circuit including an on-off operation circuit for designating a change in said accompaniment rhythm-pattern to be read out, a sequence pulse generator providing an output to the accompaniment rhythm-pattern generator for the determination of signal-read-out time of the accompaniment rhythm-pattern generator, a sound source circuit supplied with the read-out signal from the accompaniment rhythm-pattern generator for producing a selected accompaniment rhythm sound, said sound source circuit producing a first accompaniment rhythm sound when a first accompaniment rhythm-pattern is selected by said accompaniment rhythm-pattern designation circuit and producing a second accompaniment rhythm sound when a second accompaniment rhythm-pattern is selected by said accompaniment rhythm-pattern designation circuit, said sound source switching from said first to said second accompaniment rhythm sound a predetermined time after said on-off operation circuit designates a change in said accompaniment rhythm-pattern to be read out, a signal source circuit for fill-in rhythm, at least one gate opened to provide an output in response to the operation of said on-off operation circuit, a supplying means for supplying the output of the fill-in rhythm signal source to said sound source circuit to drive it in response to the output of said gate, said supplying means supplying the output of said fill-in rhythm signal source to said sound source circuit during said predetermined time, a means for generating a beat number determination signal synchronized to the accompaniment rhythm sound, and a closing means for closing said gate in synchronization with said beat number determined signal after said sound source circuit has switched from said first to said second accompaniment rhythm sound.

4. A automatic rhythm-pattern accompaniment equipment according to claim 3, wherein the fill-in rhythm signal source is synchronized with the beat number of each accompaniment rhythm-pattern generated.

5. An automatic rhythm-pattern accompaniment equipment comprising:

an accompaniment rhythm-pattern generator for storing a plurality of accompaniment rhythm-patterns, an accompaniment rhythm-pattern designation circuit for selecting a desired one of said accompaniment rhythm-patterns to be read out, a sequence pulse generator, including a frequency divider, for providing an output to the accompaniment rhythm-pattern generator for the determination of signal-read-out time of the accompaniment rhythm-pattern generator, a sound source circuit supplied with the read-out signal from the accompaniment rhythm-pattern generator and producing a selected accompaniment rhythm sound, a fill-in rhythm-pattern generator for storing a plurality of fill-in rhythm-patterns, a fill-in rhythm-pattern designation circuit for selecting a desired one of said fill-in rhythm-patterns, to be read out, said fill-in rhythm-pattern designation circuit including a plurality of independently operable switches each providing an output, a means for supplying a read-out signal from the fill-in rhythm-pattern generator to said sound source circuit, to produce a selected fill-in rhythm sound, a fill-in beat number decision circuit for generating a beat number determination signal synchronized with said accompaniment rhythm-pattern and for starting and stopping the read-out signal from the fill-in rhythm-pattern generator in synchronization with said beat number determination signal, said fill-in beat number decision circuit including a plurality of flip-flops each having an output terminal, a data input terminal and a clock input terminal, the clock input terminals of each of said flip-flops receiving a different frequency output from said frequency divider, the data input terminal of each said flip-flop being coupled to a respective one of the switch outputs from said accompaniment rhythm-pattern designation circuit, and the outputs of said flip-flops being provided to said fill-in rhythm-pattern generator as said beat number determination signal.

6. An automatic rhythm-pattern accompaniment equipment comprising:

an accompaniment rhythm-pattern generator for storing a plurality of accompaniment rhythm-patterns, an accompaniment rhythm-pattern designation circuit for selecting a desired one of said accompaniment rhythmpatterns to be read out, a sequence pulse generator providing an output to the accompaniment rhythm-pattern generator for the determination of signal read-out time of the accompaniment rhythm-pattern generator, a sound source circuit supplied with the read-out signal from the accompaniment rhythm-pattern generator for producing a selected accompaniment rhythm sound including sounds from a plurality of musical instruments, a means for generating a beat number determination signal synchronized to the accompaniment rhythm sound, a means for generating a fill-in rhythm signal representing sounds from at least one of said plurality of musical instruments, means for superimposing a fill-in rhythm onto the accompaniment rhythm sound in response to a designation of a switch-over of accompaniment rhythm-pattern, means for suppressing the portion of the accompaniment rhythm sound corresponding to said at least one musical instrument in said fill-in rhythm-pattern, and a means for stopping the superimposed fill-in rhythm in synchronization with the beat number determination signal.

7. An automatic rhythm-pattern accompaniment equipment comprising:

an accompaniment rhythm-pattern for storing a plurality of accompaniment rhythm-patterns, an accompaniment rhythm-pattern designation circuit for selecting a desired one of said accompaniment rhythm-patterns to be read out, a sequence pulse generator, including a frequency divider, for providing an output to the accompaniment rhythm-pattern generator for the determination of signal-read-out time of the accompaniment rhythm-pattern generator, a sound source circuit supplied with the read-out signal from the accompaniment rhythm-pattern generator and producing a selected accompaniment rhythm sound, a fill-in rhythm-pattern generator for storing a plurality of fill-in rhythm-patterns, a fill-in rhythm-pattern designation circuit for selecting a desired one of said fill-in rhythm-patterns, to be read out, said fill-in rhythm-pattern designation circuit including a plurality of independently operable switches each providing an output, a means for supplying a read-out signal from the fill-in rhythm-pattern generator to said sound source circuit, to produce a selected fill-in rhythm sound, a fill-in beat number decision circuit for generating a beat number determination signal synchronized with said accompaniment rhythm-pattern and for starting and stopping the read-out signal from the fill-in rhythm-pattern generator in synchronization with said beat number determination signal, said fill-in beat number decision circuit comprising a frequency divider having a plurality of different frequency outputs, an inverter for inverting one of the outputs of said frequency divider, a first condition selecting circuit receiving an input signal from the output of said fill-in rhythm-pattern designation circuit and also receiving a clock input from the output of said inverter, an AND gate having a plurality of inputs coupled to different outputs of said frequency divider, and a second condition selecting circuit receiving an input signal from the output of said first condition selecting circuit and receiving a clock signal from said AND gate, the output of said second condition selecting circuit being supplied to said fill-in rhythm-pattern generator.

8. An automatic rhythm-pattern accompaniment equipment according to claim 7, wherein one of the inputs of said AND gate is connected to the output of the frequency divider having the highest frequency.

9. An automatic rhythm-pattern accompaniment equipment according to claim 7, wherein said fill-in rhythm-pattern designation circuit includes a plurality of independently operable switches each providing an output, said first condition selecting circuit comprises a plurality of set-reset flip-flops each having a set input terminal coupled to the output of a respective one of said independently operable switches and each having a reset terminal coupled to the output of said inverter, and said second condition selecting circuit comprises a plurality of data type flip-flops each having a data input terminal coupled to an output of a respective one of said set-reset flip-flops and each receiving a clock signal from the output of said AND gate.

10. An automatic rhythm-pattern accompaniment equipment comprising:

an accompaniment rhythm-pattern generator for storing a plurality of accompaniment rhythm-patterns, an accompaniment rhythm-pattern designation circuit for selecting a desired one of said accompaniment rhythm-patterns to be read out, a sequence pulse generator providing an output to the accompaniment rhythm-pattern generator for the determination of signal-read-out time of the accompaniment rhythm-pattern generator, and a sound source circuit supplied with the read-out signal from the accompaniment rhythm-pattern generator and producing a selected accompaniment rhythm sound, a fill-in rhythm-pattern generator for storing a plurality of fill-in rhythm patterns, a fill-in rhythm-pattern designation circuit for selecting a desired one of said fill-in rhythm patterns to be read out, a means for supplying the read-out signal from the fill-in rhythm-pattern generator to said sound source circuit to produce a selected fill-in rhythm sound, a fill-in beat number decision circuit for generating a beat number determination signal synchronized with said accompaniment rhythm-pattern and for starting and stopping the read-out signal from the fill-in rhythm-pattern generator in synchronization with said beat number determination signal, and a circuit for silencing part of the accompaniment rhythm sound corresponding to a desired one or more of those musical instrument sounds involved in the accompaniment rhythm-patterns when said fill-in rhythm sound is generated.

11. An automatic rhythm-pattern accompaniment equipment according to claim 10, wherein the outputs of the accompaniment rhythm-pattern generator and those of the fill-in rhythm-pattern generator are coupled to their sound sources through accompaniment rhythm-pattern selection circuits, each of which carries out logical operation of an output the accompaniment rhythm-pattern generator representative of a certain kind of musical instrument, an output of the fill-in rhythm-pattern generator representative of the same kind of musical instrument, and a signal indicating the elimination of the sound of said kind of musical instrument, and the result of the logical operation is fed to the sound source circuit, so that a desired one or more of those musical instrument sounds involved in the accompaniment rhythm-patterns are silenced.

* * * * *